US011172281B2

(12) United States Patent
Di Censo et al.

(10) Patent No.: US 11,172,281 B2
(45) Date of Patent: Nov. 9, 2021

(54) SELF-ADJUSTING HEAD-MOUNTED AUDIO DEVICE

(71) Applicant: HARMAN INTERNATIONAL INDUSTRIES, INCORPORATED, Stamford, CT (US)

(72) Inventors: Davide Di Censo, Oakland, CA (US); Stefan Marti, Oakland, CA (US); Jaime Elliot Nahman, Oakland, CA (US); Mirjana Spasojevic, Palo Alto, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 367 days.

(21) Appl. No.: 15/748,626

(22) PCT Filed: Jul. 31, 2015

(86) PCT No.: PCT/US2015/043099

§ 371 (c)(1),
(2) Date: Jan. 29, 2018

(87) PCT Pub. No.: WO2017/023243

PCT Pub. Date: Feb. 9, 2017

(65) Prior Publication Data

US 2020/0084534 A1 Mar. 12, 2020

(51) Int. Cl.
*H04R 1/10* (2006.01)

(52) U.S. Cl.
CPC ..... *H04R 1/1041* (2013.01); *H04R 1/105* (2013.01); *H04R 1/1008* (2013.01); *H04R 1/1083* (2013.01)

(58) Field of Classification Search
CPC ..... H04R 5/02; H04R 5/033; H04R 5/0335; H04R 1/1008; H04R 1/105; H04R 1/1058;
(Continued)

(56) References Cited

U.S. PATENT DOCUMENTS

2010/0189303 A1* 7/2010 Danielson ..... H04R 1/1008 381/378
2011/0002478 A1 1/2011 Pollard et al.
(Continued)

FOREIGN PATENT DOCUMENTS

JP 20150037246 A 2/2015

OTHER PUBLICATIONS

International Search Report Application No. PCT/US2015/043099, dated Apr. 28, 2016, 12 pages.

*Primary Examiner* — Khai N. Nguyen
*Assistant Examiner* — Sabrina Diaz
(74) *Attorney, Agent, or Firm* — Artegis Law Group, LLP

(57) ABSTRACT

One embodiment of the present invention sets forth a technique for adjusting a head-mounted audio device. The technique includes determining that the head-mounted audio device has been placed on a head of a user. The technique further includes, in response to determining that the head-mounted audio device has been placed on the head of the user, causing the head-mounted audio device to transition from a first state to a second state. The first state corresponds to a first set of physical parameters associated with the head-mounted audio device, and the second state corresponds to a second set of physical parameters associated with the head-mounted audio device.

19 Claims, 6 Drawing Sheets

(58) Field of Classification Search
CPC .. H04R 1/1041; H04R 1/1083; H04R 1/1066; G06F 3/016; H04M 1/05
USPC ..... 381/374, 379, 370, 371, 74
See application file for complete search history.

(56) References Cited

U.S. PATENT DOCUMENTS

| | | | | |
|---|---|---|---|---|
| 2011/0103631 | A1* | 5/2011 | Fyke | H04R 1/1008 381/337 |
| 2013/0038458 | A1 | 2/2013 | Toivola et al. | |
| 2013/0129106 | A1* | 5/2013 | Sapiejewski | H04R 1/105 381/71.6 |
| 2014/0003646 | A1* | 1/2014 | Andersen | H04R 1/105 381/375 |
| 2014/0064500 | A1 | 3/2014 | Lee | |
| 2014/0355778 | A1* | 12/2014 | Cheng | H04R 1/1041 381/74 |
| 2015/0189422 | A1* | 7/2015 | Nakano | H04R 1/1066 381/378 |
| 2015/0201268 | A1 | 7/2015 | Chang et al. | |
| 2016/0205459 | A1* | 7/2016 | Kamada | H04R 29/001 381/74 |

* cited by examiner

SELF-ADJUSTING HEAD-MOUNTED AUDIO DEVICE

CROSS-REFERENCE TO RELATED APPLICATIONS

The present application is a national stage application of the international application titled, "SELF-ADJUSTING HEAD-MOUNTED AUDIO DEVICE," filed on Jul. 31, 2015 and having application number PCT/US2015/043099. The subject matter of this related application is hereby incorporated herein by reference.

BACKGROUND

Field of the Embodiments of the Invention

Embodiments of the present invention relate generally to audio systems and, more specifically, to a self-adjusting head-mounted audio device.

Description of the Related Art

Various technological advancements in the consumer electronics industry have dramatically increased the degree to which audio devices, such as media players, communications devices, and computers, are integrated into the daily lives of users. In order to avoid disturbing others and/or to attenuate external noise, many users listen to audio devices using a head-mounted device, such as a pair of headphones. For example, many users listen to mobile audio devices via circumaural headphones that isolate the user from distracting external noise and prevent others from hearing the audio stream to which the user is listening. Similarly, a commercial pilot may use an aviation headset to block out engine noise while communicating with co-pilots and air traffic control.

Many head-mounted audio devices include a variety of adjustment mechanisms that enable each device to comfortably and securely fit a wide variety of head shapes and sizes. As an example, many circumaural and supra-aural headphones include an adjustable headband that enables the height of the headphones to be modified. In addition, some head-mounted audio devices enable the location of the headphone speakers to be adjusted relative to various components of the head support (e.g., headband) associated with the headphones.

Although such adjustment mechanisms enable a head-mounted audio device to be worn by multiple users, making adjustments each time the head-mounted audio device is used can be onerous for the user(s). For example, an aviation headset that is shared between multiple pilots may need to be adjusted each time a new pilot enters the cockpit. In addition, even when a particular head-mounted audio device has only a single user, the user usually needs to repeatedly adjust the device over the course of time, such as when the device is stored in and later removed from a carrying case, or when the device is expanded to be worn around the user's neck and later readjusted when placed back on the user's head.

As the foregoing illustrates, more effective techniques for adjusting head-mounted audio devices would be useful.

SUMMARY

One embodiment of the present invention sets forth a system that includes a head-mounted audio device that includes at least one speaker. The system further includes at least one actuator coupled to the head-mounted audio device and a processor coupled to the at least one actuator. The process is configured to receive an indication that the head-mounted audio device has been placed on a head of a user and, in response, cause the at least one actuator to transition the head-mounted audio device from a first state to a second state. The first state corresponds to a first set of physical parameters associated with the head-mounted audio device, and the second state corresponds to a second set of physical parameters associated with the head-mounted audio device.

Further embodiments provide, among other things, a non-transitory computer-readable storage medium and a method configured to implement various aspects of the system set forth above.

At least one advantage of the disclosed techniques is that a head-mounted audio device may be automatically adjusted to comfortably and securely fit the head of a user. Accordingly, a user does not need to make manual adjustments to a head-mounted device each time the device is placed on his or her head and removed from his or her head.

BRIEF DESCRIPTION OF THE SEVERAL VIEWS OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous specific details are set forth to provide a more thorough understanding of the embodiments of the present invention. However, it will be apparent to one of skill in the art that the embodiments of the present invention may be practiced without one or more of these specific details.

Figure 1:
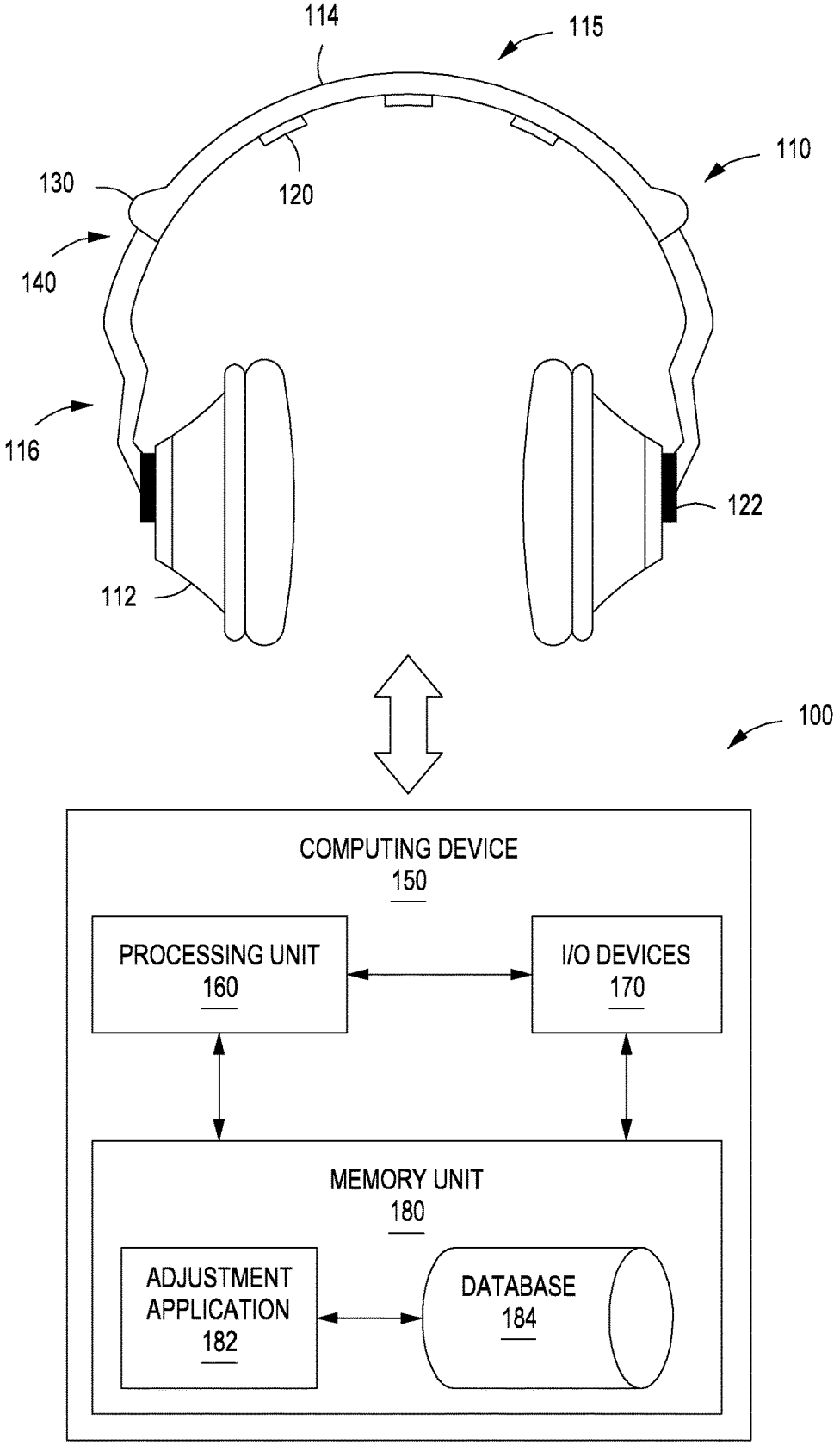
FIG. 1 illustrates a system for adjusting a head-mounted audio device, according to various embodiments.

FIG. 1 illustrates a system 100 for adjusting a head-mounted audio device 110, according to various embodiments. As shown, the system 100 includes the head-mounted audio device 110 and a computing device 150. The head-mounted audio device 110 includes speakers 112 and a head support 114. The head-mounted audio device 110 further includes one or more first sensors 120, one or more second sensors 122, and one or more actuators 130.

The first sensors 120 may include touch sensors (e.g., capacitive sensors), proximity sensors (e.g., infrared, laser, or ultrasound sensors), pressure sensors, and/or thermal sensors that are capable of detecting whether the head-mounted audio device 110 is being worn on the head of a user. The first sensors 120 may further determine the distance from various components of the head-mounted audio device 110 to the head and/or ears of the user. For example, and without limitation, the first sensors 120 may determine the distance from the head support 114 to the top of the head and/or determine whether the ears are aligned with the speakers 112, such as by determining the distance from each ear to a corresponding speaker 112. The second sensors 122 include pressure sensors capable of detecting whether the head-mounted audio device 110 is being worn on the head of a user as well as how much force the speakers 112 are exerting on the ears of the user. The first sensors 120 and/or second sensors 122 may further detect whether the head-mounted audio device 110 is being worn around the neck of the user, stored in a carrying case, or being carried, but not worn, by the user.

The head support 114 may include a headband, as shown in FIG. 1, and/or any other assembly that is capable of coupling the speakers 112 to the head of a user. For example, and without limitation, in various embodiments, the head support 114 may include a harness, a hat, a helmet, etc. to which one or more speakers 112 are coupled. In some embodiments, when worn by a user, the head support 114 contacts only one region on the head of the user (e.g., the top of the head), while, in other embodiments, the head support 114 may contact multiple regions on the head of the user (e.g., the top of the head, the sides of the head, the temple, etc.).

The head support 114 includes one or more adjustable regions 140 that enable the position(s) of one or more components of the head support 114 to be modified relative to the position(s) of the speakers 112. For example, and without limitation, the adjustable regions 140 shown in FIG. 1 enable the upper portion 115 of the head support 114 to be moved relative to the speakers 112 and the lower portions 116 of the head support 114. Accordingly, the size and shape of the head support 114, as well as the location of the head support 114 with respect to the location of the speakers 112, can be adjusted to fit the head-mounted audio device 110 to a variety of head shapes, head sizes, and ear positions, as described below in further detail in conjunction with FIGS. 2A-3B.

The actuators 130 may include various types of devices that are capable of modifying various parameters of the adjustable regions 140. Some non-limiting examples of actuators 130 that may be implemented with the head-mounted audio device 110 include mechanical motors, hydraulic and pneumatic actuators, thermal actuators, and piezoelectric actuators. The actuator(s) 130 are positioned proximate to components of the head support 114 and/or speakers 112 in order to modify the physical dimensions and relative locations of these components. For example, and without limitation, the actuators 130 illustrated in FIG. 1 are positioned proximate to the locations at which the upper region 115 of the head support 114 meets the lower regions 116 of the head support 114, enabling the position of the lower regions 116 and speakers 112 to be modified relative to the upper region 115. Accordingly, the height of the headband may be modified to enable the head support 114 to be resized to fit a variety of users. The operation of the actuators 130 is described below in further detail in conjunction with FIGS. 4, 5A, and 5B.

Although the sensors 120, 122, actuators 130, and speakers 112 shown in FIG. 1 are positioned at specific locations on the head support 114, in other embodiments, these components may be positioned at other locations on the head support 114. For example, and without limitation, second sensors 122 could be positioned on the upper region 115 and/or lower regions 116 of the head support 114 to detect forces associated with these regions. Additionally, first sensors 120 may be positioned on the lower regions 116 of the head support 114 and/or proximate to the speakers 112 in order to detect the presence and location of the head and/or ears of the user. In a non-limiting example, thermal sensors and/or proximity sensors could be positioned on or within ear pads that are disposed around the speakers 112 in order to detect when the ear(s) of the user are aligned with the speakers 112. Further, although only two adjustable regions 140 are shown in FIG. 1, any number of adjustable regions 140 may be included at any position on the head support 114 and/or speakers 112. For example, and without limitation, actuators 130 could be coupled between the speakers 112 and the head support 114 to change the angle at which the speakers 112 are oriented (e.g., up/down, forward/backward) relative to the head support 114.

Computing device 150 includes a processing unit 160, input/output (I/O) devices 170, and a memory unit 180. Memory unit 180 includes an adjustment application 182 configured to interact with a database 184. The computing device 150 is coupled to the sensors 120, 122, the actuators 130, and/or the speakers 112.

Processing unit 160 may include a central processing unit (CPU), digital signal processing unit (DSP), and so forth. In various embodiments, the processing unit 160 is configured to execute the adjustment application 182 to analyze data acquired by the sensor(s) 120, 122 and to determine biometric data and locations, distances, orientations, etc. of the speakers 112, components of the head support 114, and/or head and ears of a user. The biometric data and locations, distances, orientations, etc. of components and/or the user may be stored in the database 184. The processing unit 160 is further configured to execute the adjustment application 182 to control the operation of the actuators 130. For example, and without limitation, the processing unit 160 may receive data from the sensors 120, 122 and process the data to determine whether the head support 114 is in contact with the head of the user and/or whether the speakers 112 are properly aligned with the ears of the user. Then, based on the data received from the sensors 120, 122, the processing unit 160 causes adjustments to be made to the adjustable regions 140 of the head support 114 via one or more actuators 130.

I/O devices 170 may include input devices, output devices, and devices capable of both receiving input and providing output. For example, and without limitation, I/O devices 170 may include wired and/or wireless communication devices that send data to and/or receive data from the sensor(s) 120, 122, the speakers 112, and/or various types of audio devices (e.g., media players, smartphones, computers, radios, and the like) to which the system 100 may be coupled. Further, in some embodiments, the I/O devices 170 include one or more wired or wireless communication devices that receive (e.g., via a network, such as a local area network and/or the Internet) biometric data associated with one or more users and/or audio streams that are to be reproduced by the speakers 112.

Memory unit 180 may include a memory module or a collection of memory modules. Adjustment application 182 within memory unit 180 may be executed by processing unit 160 to implement the overall functionality of the computing device 150, and, thus, to coordinate the operation of the system 100 as a whole. The database 184 may store biometric data, location data, orientation data, algorithms, audio streams, object recognition data, etc.

Computing device 150 as a whole may be a microprocessor, an application-specific integrated circuit (ASIC), a system-on-a-chip (SoC), a mobile computing device such as a tablet computer or cell phone, a media player, and so forth. In other embodiments, the computing device 150 may be coupled to, but separate from the system 100. In such embodiments, the system 100 may include a separate processor that receives data (e.g., biometric data, actuator 130 states, audio streams) from and transmits data (e.g., sensor data) to the computing device 150, which may be included in a consumer electronic device, such as a smartphone, portable media player, personal computer, vehicle head unit, navigation system, etc. For example, and without limitation, the computing device 150 may communicate with an external device that provides additional processing power. However, the embodiments disclosed herein contemplate any technically feasible system configured to implement the functionality of the system 100.

In operation, the first sensors 120 and/or the second sensors 122 track whether the head-mounted audio device 110 has been placed on the head of a user. When the first sensors 120 and/or the second sensors 122 detect that the head-mounted audio device 110 has been placed on the head of a user, the sensors 120, 122 transmit an indication to the processing unit 160. The processing unit 160 then causes the actuators 130 to begin transitioning the head-mounted audio device 110 from a first state to a second state. For example, and without limitation, if the head-mounted audio device 110 is removed from storage (e.g., a carrying case) and placed on the head of the user, the head support 114 could initially be in a collapsed state (e.g., with each adjustable region 140 at a minimum setting). Consequently, when the head support 114 is placed in contact with the top of the user's head, the speakers 112 would not be properly aligned with the user's ears. Accordingly, the processing unit 160 would cause the actuators 130 to modify the adjustable regions 140 to increase the distance between the speakers 112 and the upper region 115 of the head support 114 and align the speakers 112 with the user's ears.

Alternatively, the head support 114 could be in an elongated state (e.g., with one or more adjustable regions 140 at or near a maximum setting) prior to being placed on the head of the user. Then, when the user places the speakers 112 over his or her ears, the head support 114 may not be in contact with the top of the user's head. Accordingly, the processing unit 160 would cause the actuators 130 to modify one or more of the adjustable regions 140 to decrease the distance between the speakers 112 and the upper region 115 of the head support 114 so that the headband rests securely on the top of the user's head.

In some embodiments, the head-mounted audio device 110 transitions between two or more states (e.g., from the first state to the second state) based on sets of physical parameters that are stored in the database 184. For example, and without limitation, biometric data associated with a particular user could be stored in the database 184 and used to determine a set of physical parameters, such as the distances between components of the head support 114 and the speakers 112, distances between various components of the head support 114, and/or orientations of components of the head support 114 relative to the speakers 112. Then, when a user puts the head-mounted audio device 110 on his or her head, the head-mounted audio device 110 could transition to a state that is associated with the user's biometric data and set of physical parameters.

Additionally, in some embodiments, the head-mounted audio device 110 transitions between two or more states based on feedback received from the first sensors 120 and/or the second sensors 122. For example, and without limitation, when a user puts the head-mounted audio device 110 on his or her head, the first sensors 120 could transmit sensor data to the processing unit 160, which would then determine, based on the sensor data, the distance between components of the head support 114 and the user's head, whether the ears are properly aligned with the speakers 112, whether the speakers 112 are at the proper angle relative to the user's ears/head, whether the speaker(s) 112 are exerting a proper amount of force on the user's ear(s), etc. The processing unit 160 could then adjust the actuators 130, based on the feedback received from the sensors 120, 122, until the head support 114 is properly fitted to the user's head, until the speakers 112 are properly aligned with the user's ear(s), until the speakers 112 are oriented properly relative to the user, and/or until an appropriate amount of force is being placed on the user's ear(s) by the speaker(s) 112.

In some embodiments, the user may press a button (e.g. on the head-mounted audio device 110 itself or on a remote control, such as a smartphone application) to indicate, via an I/O device 170, that the head-mounted audio device 110 should transition to a particular state. For example, and without limitation, after placing the head-mounted audio device 110 on his or her head, the user could transmit an identifier to the head-mounted audio device 110, such as by logging into an application associated with the head-mounted audio device 110. Biometric data and/or a set of physical parameters (e.g., distances, orientations, angles, pressures, etc.) associated with the identifier would then be retrieved from the database 184 (or from a remote database), and the head-mounted audio device 110 would transition to a state associated with the biometric data and/or physical parameters.

Additionally, a user may press a button to store a set of physical parameters in the database 184. For example, and without limitation, a user could put the head-mounted audio device 110 on his or her head and adjust the head support 114 so that the head-mounted audio device 110 fits comfortably. The user could then press a button to store the state of the head-mounted audio device 110 (e.g., to store a set of physical parameters that correspond to the preferred state of the head-mounted audio device 110) in the database 184 or in a remote database (e.g., cloud storage). In some embodiments, the set of physical parameters may be stored in conjunction with a user identifier. Then, the next time the user puts the head-mounted audio device 110 on his or her head, the head-mounted audio device 110 would automatically return to the preferred state (e.g., when the user presses a button or when the adjustment application 182 detects that the head-mounted audio device 110 has been placed on a user's head).

In some embodiments, the adjustment application 182 may identify the user via one or more sensors that detect biometric information associated with the user. After identifying the user, the adjustment application 182 then accesses a set of physical parameters associated with the user (e.g., associated with a user identifier) and adjusts the head-mounted audio device 110 to the preferred state. For example, and without limitation, the adjustment application 182 could retrieve the set of physical parameters from the database 184 and/or download the set of physical parameters from a remote server (e.g., by downloading dimensions of the user's head that were measured and/or stored by an online service). Additionally, if a new user is identified, the adjustment application 182 may store a set of physical parameters (e.g., in the database 184 and/or on a remote server) based on the specific physical adjustments the new user makes to the head-mounted audio device 110.

For example, and without limitation, the adjustment application 182 could identify a new or existing user via a fingerprint sensor while the user is holding the head-mounted audio device 110. The adjustment application 182 could then adjust the head-mounted audio device 110 to a preferred state associated with the user. In other non-limiting examples, the adjustment application 182 include a heartbeat sensor that identifies a new or existing user by detecting specific characteristics of the user's heartbeat and/or a microphone that identifies a new or existing user by detecting specific characteristics of the user's voice (e.g., a voiceprint or voice identifier). In addition, after adjusting the head-mounted audio device 110 to a preferred state associated with a user, the adjustment application 182 may detect adjustments the user makes to the head-mounted audio device 110 and update the set of physical parameters associated with the corresponding user identifier. In general, any technically feasible sensor for detecting biometric information associated with a user may be implemented with the head-mounted audio device 110.

The head-mounted audio device 110 may further include additional states, such as a storage state, an around-the-neck state, etc. For example, and without limitation, the head-mounted audio device 110 could transition to a storage state, in which the actuators 130 adjust each of the adjustable regions 140 to a minimum position (e.g., a fully collapsed state). A transition to the storage state may be initiated when the sensors 120, 122 detect that the head-mounted audio device 110 is being put into storage and/or when the user presses a button indicating that the head-mounted audio device 110 is being put into storage.

In another non-limiting example, the head-mounted audio device 110 could transition (e.g., in response to sensor data and/or a button press) to an around-the-neck state, such as when the user has removed the head-mounted audio device 110 to engage in a conversation, listen to the environment, take a break from listening to music, etc. When transitioning to the around-the-neck state, the actuators 130 could adjust each of the adjustable regions 140 towards a maximum position (e.g., an expanded state) in order to prevent the head-mounted audio device 110 from uncomfortably squeezing the neck or face of the user. The head-mounted audio device 110 may then transition from the storage state or the around-the-neck state back to the appropriate state when placed back on the head of the user. Accordingly, the user does not need to manually adjust the head-mounted audio device 110 each time the device is put on and removed from the head of the user.

Figure 2A:
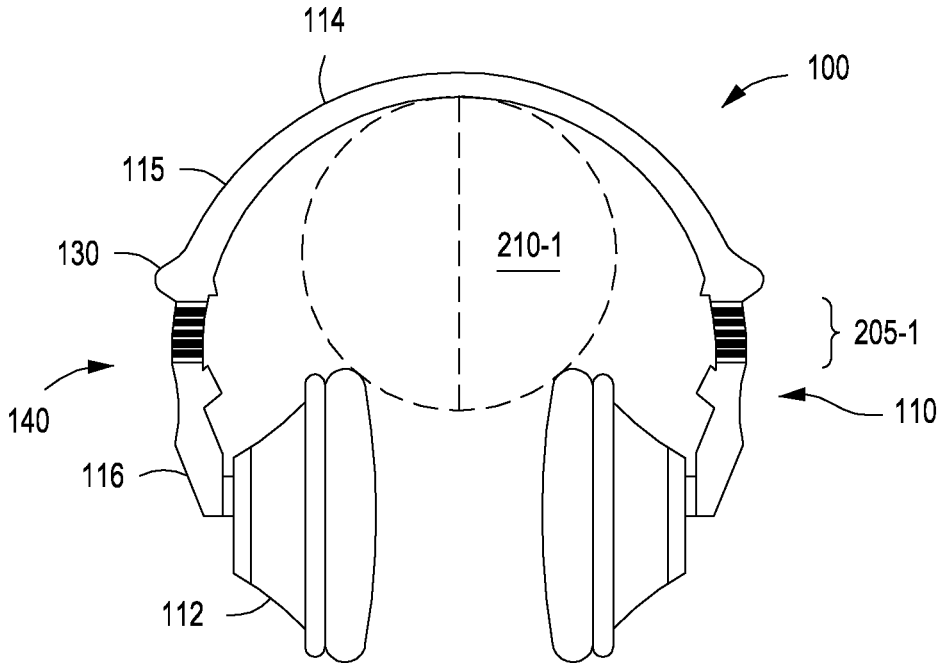
FIGS. 2A and 2B illustrate a height adjustment that may be implemented in conjunction with the head-mounted audio device of FIG. 1, according to various embodiments.
Figure 2B:
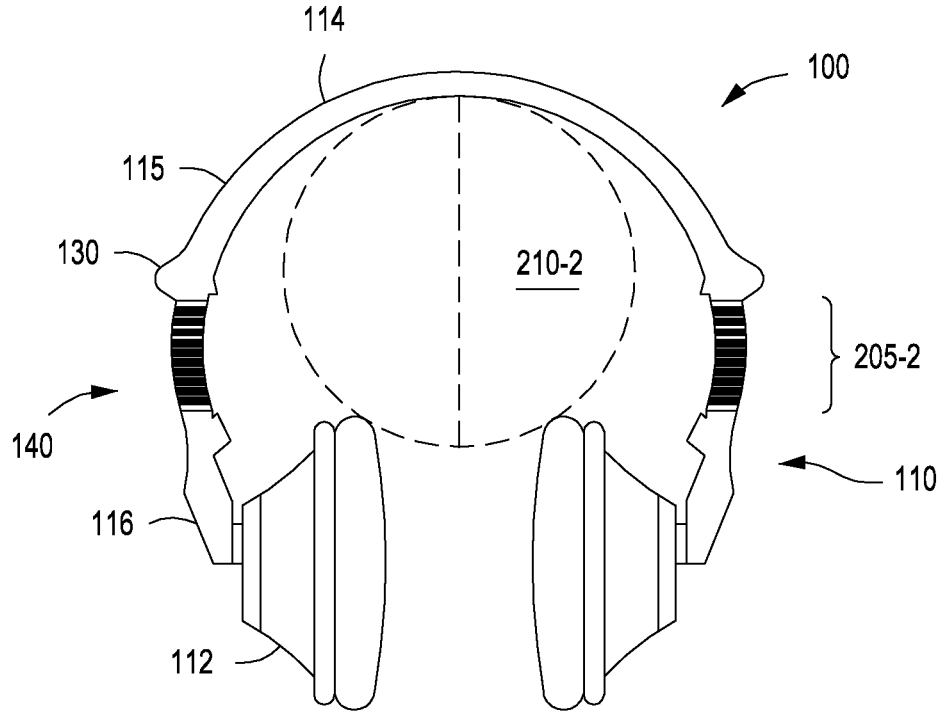

FIGS. 2A and 2B illustrate a height adjustment that may be implemented in conjunction with the head-mounted audio device 110 of FIG. 1, according to various embodiments. As shown, one or more actuators 130 could be adjusted to expand the adjustable regions 140 from a first state associated with a first height 205-1 to a second state associated with a second height 205-2, causing the overall height of the head support 114 to increase. Such adjustments could automatically occur in response to a button press and/or after the head-mounted audio device 110 is placed on a user's head, such as when the dimensions of the head support 114 need to be increased to comfortably fit the user and/or properly align the speaker(s) 112 with the ear(s) of the user. Additionally, in some embodiments, such adjustments could automatically occur when the inner diameter of the head support 114 needs to be increased from a first state associated with a first diameter 210-1 to a second state associated with a second diameter 210-2, such as when the user places the head-mounted audio device 110 around his or her neck.

Although the exemplary adjustments shown in FIGS. 2A and 2B are shown with respect to specific adjustment regions 140 on the head support 114, similar techniques may be used to adjust any type of component included in the head support 114. For example, and without limitation, similar techniques may be used to modify the distance between the speakers 112 and/or the force between the speaker(s) 112 and the ear(s) of the user, as described below in further detail in conjunction with FIGS. 3A and 3B.

Figure 3A:
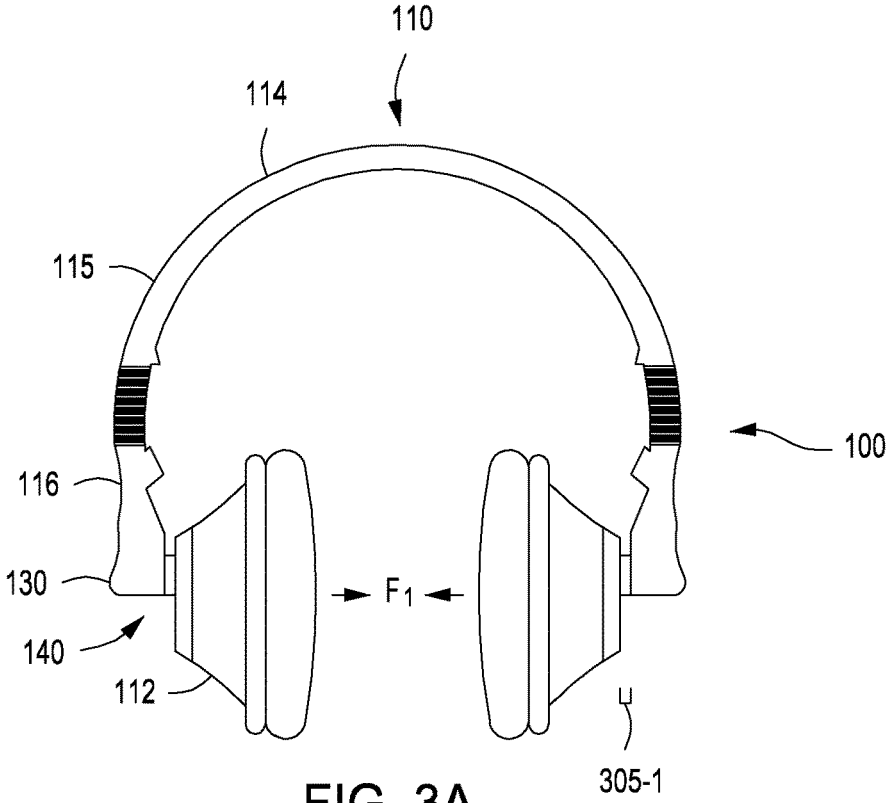
FIGS. 3A and 3B illustrate a force adjustment that may be implemented in conjunction with the head-mounted audio device of FIG. 1, according to various embodiments.
Figure 3B:
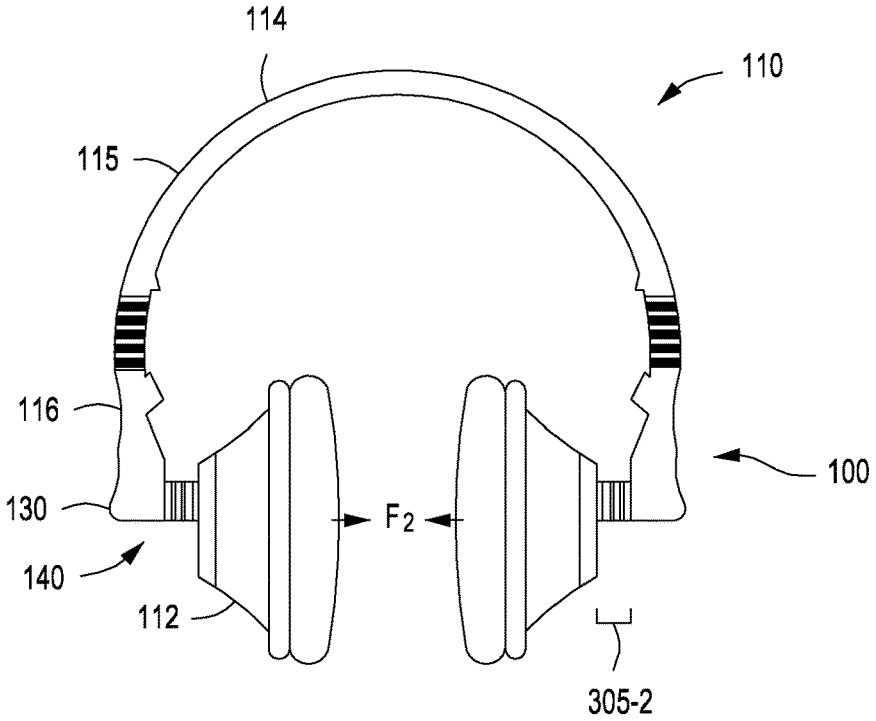

FIGS. 3A and 3B illustrate a force adjustment that may be implemented in conjunction with the head-mounted audio device 110 of FIG. 1, according to various embodiments. As shown, one or more actuators 130 could be adjusted to expand adjustable regions 140 proximate to the speakers 112 from a first state associated with a first width 305-1 to a second state associated with a second width 305-2, causing the distance between the speakers 112 to decrease and/or the force between the speaker(s) 112 and the ear(s) of the user to increase. Such adjustments could be made when the force between the ear pad(s) of the speaker(s) 112 and the ear(s) of the user is too high, making the user uncomfortable, or too low, causing the head-mounted audio device 110 to be insecurely mounted on the user's head and ears.

Additionally, in some embodiments, the head-mounted audio device 110 could include noise isolation characteristics (e.g., passive or active noise cancellation) and an externally mounted microphone that detects noise levels in the surrounding environment. Then, in response to detecting elevated noise levels in the environment, the head-mounted audio device 110 may automatically increase the force between the ear pad of the speaker(s) 112 and the ear(s) of the user (e.g. from $F_1$ to $F_2$), increasing the degree to which external noises are attenuated. The head-mounted audio device 110 may further automatically decrease the force between the ear pad of the speaker(s) 112 and the ear(s) of the user (e.g. from $F_2$ to $F_1$) once the external noise level has fallen below a threshold level.

Figure 4:
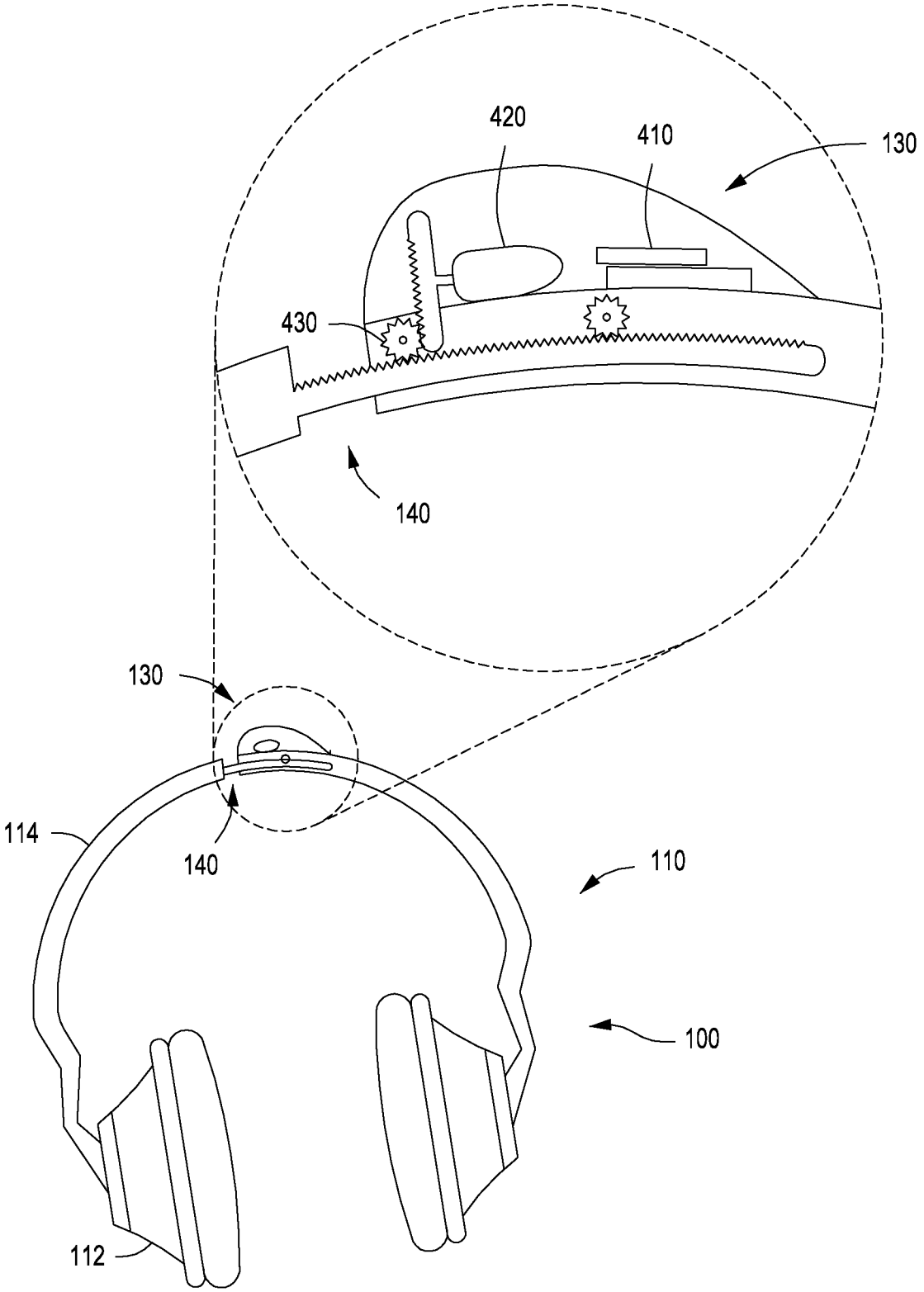
FIG. 4 illustrates an actuator configured to automatically adjust the head-mounted audio device of FIG. 1, according to various embodiments.

FIG. 4 illustrates an actuator 130 configured to automatically adjust the head-mounted audio device 110 of FIG. 1, according to various embodiments. As shown, the actuator 130 may include a mechanical actuator having a microcontroller 410, a motor 420, and transfer gears 430. In operation, the microcontroller 410 may receive signals from the processing unit 160 and, in response, cause the motor 420 to turn the transfer gears 430. Movement of the transfer gears 430 then causes the adjustable region 140 of the head support 114 to expand or retract.

In some embodiments, an adjustable region 140 of the head support 114 could be expanded via the actuator to increase the height of a headband or retracted to decrease the height of the headband. Although the actuator 130 illustrated in FIG. 4 is coupled to the top of the head support 114, in other embodiments, similar actuators 130 may be coupled to any region of the head support 114 and/or speakers 112 to automatically adjust the physical parameters of the head-mounted audio device 110. For example, and without limitation, such actuators 130 could be used to increase or decrease the force between the speakers 112 and the user's ears and/or to change the angle at which the speakers 112 are positioned relative to the user's head by expanding and retracting one or more adjustable regions located between the speaker(s) 112 and the head support 114.

Figure 5A:
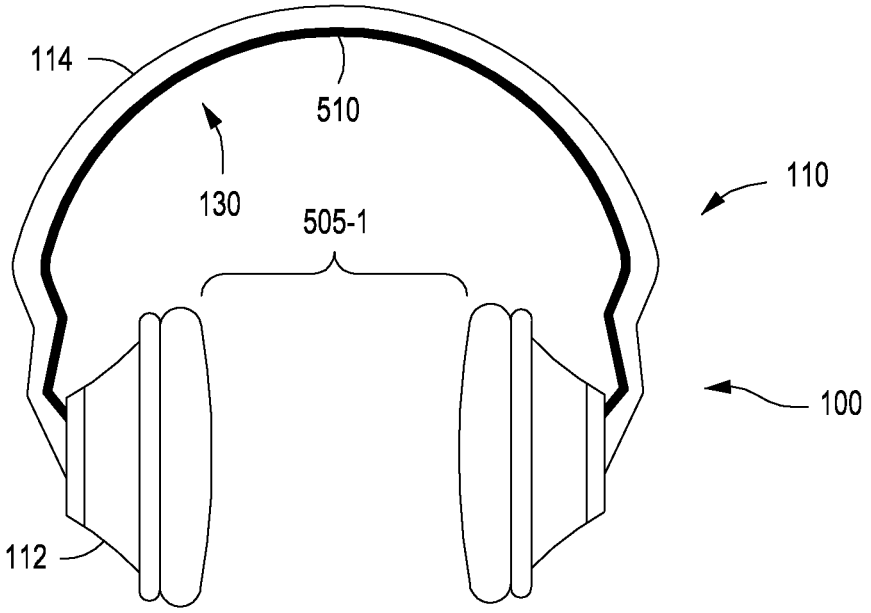
FIGS. 5A and 5B illustrate a technique for adjusting the head-mounted audio device of FIG. 1 via a shape-memory material according to various embodiments.
Figure 5B:
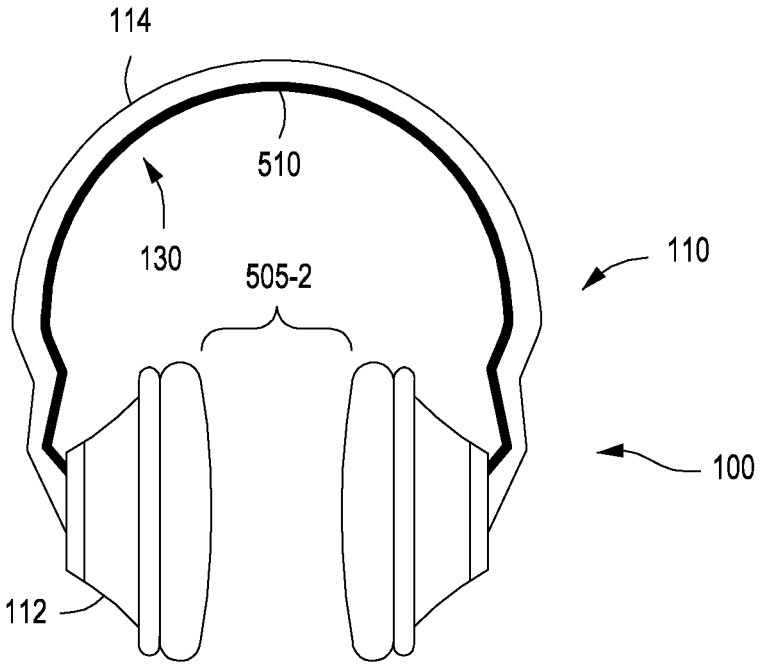

FIGS. 5A and 5B illustrate a technique for adjusting the head-mounted audio device 110 of FIG. 1 via a shape-memory material, according to various embodiments. As shown, a shape-memory material actuator 130 may be coupled to the head support 114 of the head-mounted audio device 110 in order to adjust one or more physical parameters of the device, such as any of the physical parameters described above in conjunction with FIGS. 1-4. In the illustrated embodiment, a layer 510 of shape-memory material, such as a shape-memory alloy or a shape-memory polymer, is coupled to the underside of the headband in order to change the shape of the headband, the height of the headband, and/or the force between the speakers 112 and the ears of the user.

In operation, upon receiving an indication that the head-mounted audio device 110 should be transitioned between one or more states, the processing unit 160 may cause an external stimulus, such as voltage or temperature change, to be applied to the shape-memory material actuator 130. In response, the length of the layer 150 decreases, causing the headband to fold or bow inward. Accordingly, the head-mounted audio device 110 transitions from a first state associated with a first distance 505-1 between the speakers 112 to a second state associated with a second distance 505-2 between the speakers 112. Additionally, application of a stimulus to the shape-memory material actuator 130 may cause the length of the layer 150 to increase, causing the headband to fold or bow outward. Thus, when the head-mounted audio device 110 is being worn by a user, application of a stimulus may increase or decrease the force between the ear pad(s) of the speaker(s) 112 and the ear(s) of the user.

The processing unit 160 may receive an indication that the head-mounted audio device 110 should be transitioned between one or more states via any of the techniques described herein. In one non-limiting example, after a user removes the head-mounted audio device 110 from his or her head, a button may be pressed to apply a stimulus to the shape-memory material actuator 130, causing the head-mounted audio device 110 to transition to a storage state or an around-the-neck state. Additionally, when a user would like to put the head-mounted audio device 110 on his or her head, a button may be pressed to apply a different stimulus to the shape-memory material actuator 130, causing the head-mounted audio device 110 to return to a preferred state, such as a set of physical parameters associated with a particular user identifier.

Figure 6:
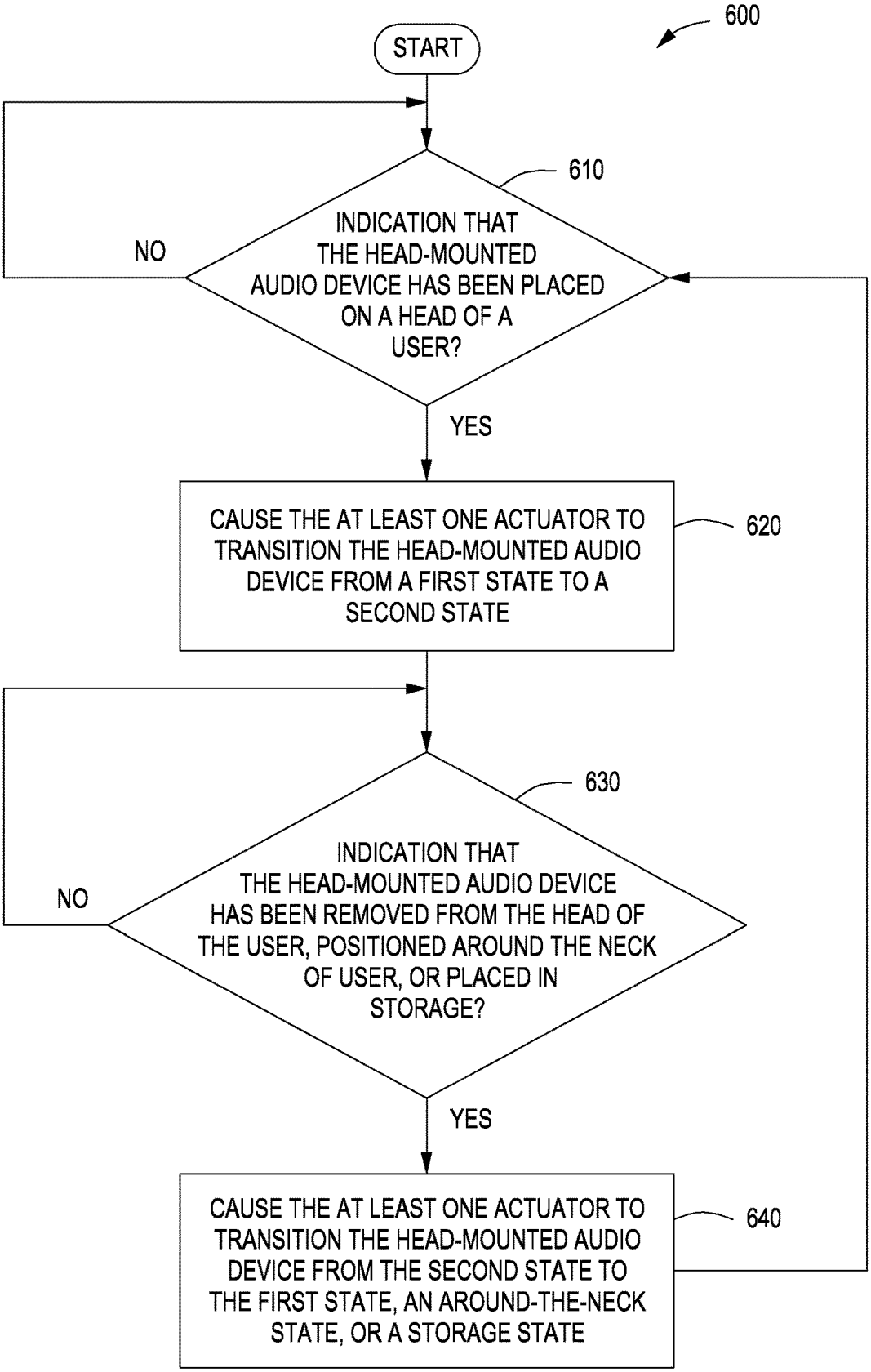
FIG. 6 is a flow diagram of method steps for adjusting a head-mounted audio device, according to various embodiments.

FIG. 6 is a flow diagram of method steps for adjusting a head-mounted audio device, according to various embodiments. Although the method steps are described in conjunction with the systems of FIGS. 1-5B, persons skilled in the art will understand that any system configured to perform the method steps, in any order, falls within the scope of the present invention.

As shown, a method 600 begins at step 610, where the adjustment application 182 executing on the processing unit 160 determines whether an indication has been received that the head-mounted audio device 110 has been placed on a head of a user. As described herein, an indication that the head-mounted audio device 110 has been placed on a head of a user may be received via a button press (e.g., a physical button on the head-mounted audio device 110, a virtual button in a software application, etc.). Additionally, in some embodiments, the indication may be received in response to analyzing data acquired by the first sensors 120 and/or second sensors 122 and determining, based on the sensor data, that the head-mounted audio device 110 has been placed on a head of a user.

If the adjustment application 182 determines that an indication has not been received, then the method 600 remains at step 610 and continues to wait for an indication. If the adjustment application 182 determines that an indication has been received, then the method 600 proceeds to step 620, where the adjustment application 182 causes at least one actuator 130 to transition the head-mounted audio device from a first state associated with a first set of physical parameters (e.g., a storage state, an undefined state, a state associated with a different user, etc.) to a second state associated with a second set of physical parameters. As described herein, the adjustment application 182 could cause the actuator(s) 130 to transition the head-mounted audio device 110 to the second state based on a set of physical parameters that are stored in the database 184. For example, and without limitation, biometric data associated with a particular user could be stored in the database 184 and retrieved by the adjustment application 182 to determine physical parameters, such as the distances between components of the head support 114 and the speakers 112, the orientations/angles of the speakers 112 relative to the head support, distances/orientations between various components of the head support 114 itself, forces between components of the head support 114 and the user's head/ears, and/or forces between the speakers 112 and the user's head/ears.

Additionally, in some embodiments, the adjustment application 182 could cause the actuator(s) 130 to transition the head-mounted audio device 110 to the second state based on feedback received from the first sensors 120 and/or the second sensors 122. For example, and without limitation, the first sensors 120 could transmit sensor data to the adjustment application 182, which would then determine, based on the sensor data, the distance between components of the head support 114 and the user's head, whether the ears are properly aligned with the speakers 112, whether the speakers 112 are at the proper angle relative to the user's ears/head, whether an appropriate amount of force is being applied to the user's head and/or ears, etc.

Next, at step 630, the adjustment application 182 determines whether an indication has been received that the head-mounted audio device 110 has been removed from the head of the user, positioned around the neck of the user, or placed in storage. As described above, such indications may be received via a button press and/or in response to analyzing data acquired by the first sensors 120 and/or second sensors 122. If the adjustment application 182 determines that an indication has not been received, then the method 600 remains at step 630 and continues to wait for an indication. If the adjustment application 182 determines that an indication has been received, then the method 600 proceeds to step 640.

At step 640, the adjustment application 182 causes at least one actuator 130 to transition the head-mounted audio device 110 from the second state to an around-the-neck state, to a storage state, or back to the first state. As described above, the adjustment application 182 could cause the actuator(s) 130 to transition the head-mounted audio device 110 to an around-the-neck state, to a storage state, or back to the first state based on a set of physical parameters that are stored in the database 184. Additionally, the adjustment application 182 could cause the actuator(s) 130 to transition the head-mounted audio device 110 to an around-the-neck state, to a storage state, or back to the first state based on feedback received from the first sensors 120 and/or the second sensors 122. The method 600 then returns to step 610, previously described herein.

In sum, the adjustment application receives an indication that the head-mounted audio device has been placed on the head of the user and, in response, causes the actuators to adjust the head-mounted audio device based on a particular set of physical parameters. Then, when the adjustment application receives an indication that the head-mounted audio device has been removed from the head of the user, the adjustment application causes the actuators to adjust the head-mounted audio device based on a different set of physical parameters (e.g., parameters associated with an around-the-neck state, a storage state, or a different user state).

At least one advantage of the techniques described herein is that a head-mounted audio device may be automatically adjusted to comfortably and securely fit the head of a user. Accordingly, a user does not need to make manual adjustments to a head-mounted device each time the device is placed on his or her head and removed from his or her head. Additionally, the head-mounted device may automatically modify the attenuation of external noise by increasing or decreasing the force between the speakers and the ears of the user.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable processors.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The invention has been described above with reference to specific embodiments. Persons of ordinary skill in the art, however, will understand that various modifications and changes may be made thereto without departing from the broader spirit and scope of the invention as set forth in the appended claims. For example, and without limitation, although many of the descriptions herein refer to specific types of actuators, sensors, and head supports, persons skilled in the art will appreciate that the systems and techniques described herein are applicable to other types of actuators, sensors, and head supports. The foregoing description and drawings are, accordingly, to be regarded in an illustrative rather than a restrictive sense.

While the preceding is directed to embodiments of the present disclosure, other and further embodiments of the disclosure may be devised without departing from the basic scope thereof, and the scope thereof is determined by the claims that follow.

What is claimed is:

1. A system, comprising:

a head-mounted audio device that includes at least one speaker;

at least one actuator coupled to the head-mounted audio device; and a processor coupled to the at least one actuator and configured to:

receive an indication that the head-mounted audio device has been placed on a head of a user; and in response, cause the at least one actuator to transition the head-mounted audio device from a first state to a second state, wherein the first state corresponds to a first set of physical parameters associated with the head-mounted audio device, and the second state corresponds to a second set of physical parameters associated with the head-mounted audio device, and wherein the first set of physical parameters includes a first distance between the at least one speaker and a lower portion of a head support portion of the head-mounted audio device and a first angle of the at least one speaker relative to the head support portion, and the second set of physical parameters includes a second distance between the at least one speaker and the lower portion of the head support portion and a second angle of the at least one speaker relative to the head support portion;

wherein the at least one actuator comprises an actuator coupled between the at least one speaker and the head support portion, the actuator being configured to change an angle of the at least one speaker relative to the head support portion.

2. The system of claim 1, wherein the first set of physical parameters includes a third distance between the at least one speaker and the head support portion of the head-mounted audio device, and the second set of physical parameters includes a fourth distance between the at least one speaker and the head support portion.

3. The system of claim 1, wherein the first set of physical parameters includes a third distance between a first speaker and a second speaker, and the second set of physical parameters includes a fourth distance between the first speaker and the second speaker.

4. The system of claim 1, further comprising a force sensor coupled to the at least one speaker and configured to measure a force between the at least one speaker and an ear of the user, wherein the second set of physical parameters includes predetermined force between the at least one speaker and the ear of the user.

5. The system of claim 1, wherein the head-mounted audio device further includes a headband, and further comprising at least one sensor coupled to the headband and configured to detect, in the first state, when the headband is not in contact with a top part of the head of the user, and, in the second state, when the headband is in contact with the top part of the head of the user.

6. The system of claim 1, further comprising at least one sensor configured to detect, in the first state, when the at least one speaker is not aligned with an ear of the user, and, in the second state, when the at least one speaker is aligned with the ear of the user.

7. The system of claim 1, further comprising at least one sensor configured to detect when the head-mounted audio device has been placed on the head of the user, and, in response, transmit the indication to the processor.

8. The system of claim 1, wherein the processor is further configured to:

receive a second indication that the head-mounted audio device has been removed from the head of the user; and in response, cause the at least one actuator to transition the head-mounted audio device from the second state to the first state or a third state, wherein the third state corresponds to a third set of physical parameters associated with the head-mounted audio device.

9. The system of claim 1, wherein the head-mounted audio device further includes a headband, and the processor is further configured to:

receive a second indication that the headband has been placed around a neck of the user; and in response, cause the at least one actuator to transition the head-mounted audio device from the second state to a third state that corresponds to a third set of physical parameters associated with the head-mounted audio device, wherein the second set of physical parameters includes a first headband height, the third set of physical parameters includes a second headband height, and the second headband height is greater than the first headband height.

10. A non-transitory computer-readable storage medium including instructions that, when executed by a processor, cause the processor to adjust a head-mounted audio device, by performing the steps of:

determining that the head-mounted audio device has been placed on a head of a user; and in response, causing the head-mounted audio device to transition from a first state to a second state via at least one actuator included in the head-mounted audio device, wherein the first state corresponds to a first set of physical parameters associated with the head-mounted audio device, and the second state corresponds to a second set of physical parameters associated with the head-mounted audio device, and wherein the first set of physical parameters includes a first distance between a speaker included in the head-mounted audio device and a lower portion of a head support portion of the head-mounted audio device and a first angle of the speaker relative to the head support portion, and the second set of physical parameters includes a second distance between the speaker included in the head-mounted audio device and the lower portion of the head support portion and a second angle of the speaker relative to the head support portion;

wherein the at least one actuator comprises an actuator coupled between the speaker and the head support portion, the actuator being configured to change an angle of the speaker relative to the head support portion.

11. The non-transitory computer-readable storage medium of claim 10, wherein determining that the head-mounted audio device has been placed on the head of the user comprises receiving sensor data, and processing the sensor data to determine that the head support portion of the head-mounted audio device or the speaker included in the head-mounted audio device is in contact with the head of the user or an ear of the user.

12. The non-transitory computer-readable storage medium of claim 11, further comprising determining that the head-mounted audio device has been removed from the head of the user by processing the sensor data to determine that the head support portion or the speaker is no longer in contact with the head of the user or the ear of the user.

13. The non-transitory computer-readable storage medium of claim 10, further comprising determining that the head-mounted audio device has reached the second state by:

receiving sensor data; and processing the sensor data to determine that a headband of the head-mounted audio device is in contact with a top of the head of the user or that the speaker included in the head-mounted audio device is aligned with an ear of the user.

14. The non-transitory computer-readable storage medium of claim 10, wherein the head-mounted audio device includes a headband, and causing the head-mounted audio device to transition from the first state to the second state comprises modifying a stimulus applied to a shape-memory material included in the headband.

15. The non-transitory computer-readable storage medium of claim 14, wherein the first set of physical parameters correspond to a first headband shape, and the second set of physical parameters correspond to a second headband shape.

16. The non-transitory computer-readable storage medium of claim 10, wherein causing the head-mounted audio device to transition from the first state to the second state comprises causing the at least one actuator included in the head-mounted audio device to reduce at least one of a third distance between the head support portion of the head-mounted audio device and the speaker included in the head-mounted audio device, and a fourth distance between speakers included in the head-mounted audio device.

17. The non-transitory computer-readable storage medium of claim 10, wherein causing the head-mounted audio device to transition from the first state to the second state comprises:

determining, via a microphone, that an ambient noise level has reached a threshold level; and in response, causing the at least one actuator included in the head-mounted audio device to modify at least one physical dimension of the head-mounted audio device until a force between the speaker included in the head-mounted audio device and an ear of the user reaches a predetermined force.

18. The non-transitory computer-readable storage medium of claim 10, further comprising:

receiving a user identifier associated with the user;

accessing biometric information associated with the user identifier; and determining the second set of physical parameters based on the biometric information.

19. A method for adjusting a head-mounted audio device, the method comprising:

determining that the head-mounted audio device has been placed on a head of a user;

in response, causing the head-mounted audio device to transition from a first state to a second state;

determining that the head-mounted audio device has reached the second state by receiving sensor data and processing the sensor data to determine that a headband of the head-mounted audio device is in contact with a top of the head of the user or a speaker included in the head-mounted audio device is aligned with an ear of the user;

determining that the head-mounted audio device is being put into storage; and in response, causing the head-mounted audio device to transition from the second state to a third state, wherein the third state includes a physical arrangement of the speaker relative to the headband that is associated with storage of the head-mounted audio device and is different than a physical arrangement of the speaker relative to the headband in the second state.

* * * * *